US005327600A

United States Patent [19]

Hoogendoorn

[11] Patent Number: 5,327,600

[45] Date of Patent: Jul. 12, 1994

[54] PATIENT GURNEY WITH ADJUSTABLE HAND HOLDS

[76] Inventor: Gilbert C. Hoogendoorn, 600 S. Kiwanis Ave., Apt. 319, Sioux Falls, S. Dak. 57104

[21] Appl. No.: 14,538

[22] Filed: Feb. 8, 1993

[51] Int. Cl.[5] ..... A61G 1/02

[52] U.S. Cl. ..... 5/625; 5/621; 5/312; 5/315.1

[58] Field of Search ..... 5/625, 626, 627, 312, 5/315.2, 315.2, 430; 280/47.17, 47.24; 296/20

[56] References Cited

U.S. PATENT DOCUMENTS 2,394,245 2/1946 Koller ..... 5/626 X
2,504,323 8/1951 Kelly ..... 296/20
3,111,187 11/1963 Sacks ..... 5/627
4,641,385 2/1987 Peters et al. ..... 5/430
5,179,746 1/1993 Rogers ..... 5/625

FOREIGN PATENT DOCUMENTS 2650618 5/1977 Fed. Rep. of Germany .

*Primary Examiner*—Michael F. Trettel

[57] ABSTRACT

A patient gurney with adjustable hand holds for easy carrying. The hand holds are spaced from the plane of the bed of the gurney and are arranged so that one set may above that plane and one set below so that the device may be readily carried down stairways. A locking device contained within a tubular collar on a rail of the gurney is used to hold the hand holds in position.

5 Claims, 2 Drawing Sheets

PATIENT GURNEY WITH ADJUSTABLE HAND HOLDS

BACKGROUND AND SUMMARY OF THE INVENTION

This invention pertains to a gurney or stretcher adapted to carry a disabled patient from one place to another, ordinarily from the locale of the disablement to an ambulance.

In most cases of sudden disablement whether by illness such as stroke or heart attack or by sudden accidental injury, it is necessary to transport the patient from the locale where the disablement occurred to an ambulance and then to a hospital or similar facility. Present gurneys or stretchers are adequate in many instances where the patient and the ambulance are near the same level. However, where it may be necessary to go up or down stairs, the use of a current type of device may be difficult. The carrying of a stretcher having only a straight rod for a handle when that rod must be carried at a considerable slope is difficult enough. Further, the patient in some cases is apt to be tilted more than may be desirable.

By the present invention a gurney is provided having handles placed and adapted to give the handlers a much easier and more convenient device to use on stairways and steep slopes. The handles are moveable between positions to make the device adaptable to carrying uses.

DESCRIPTION

Figure 1:
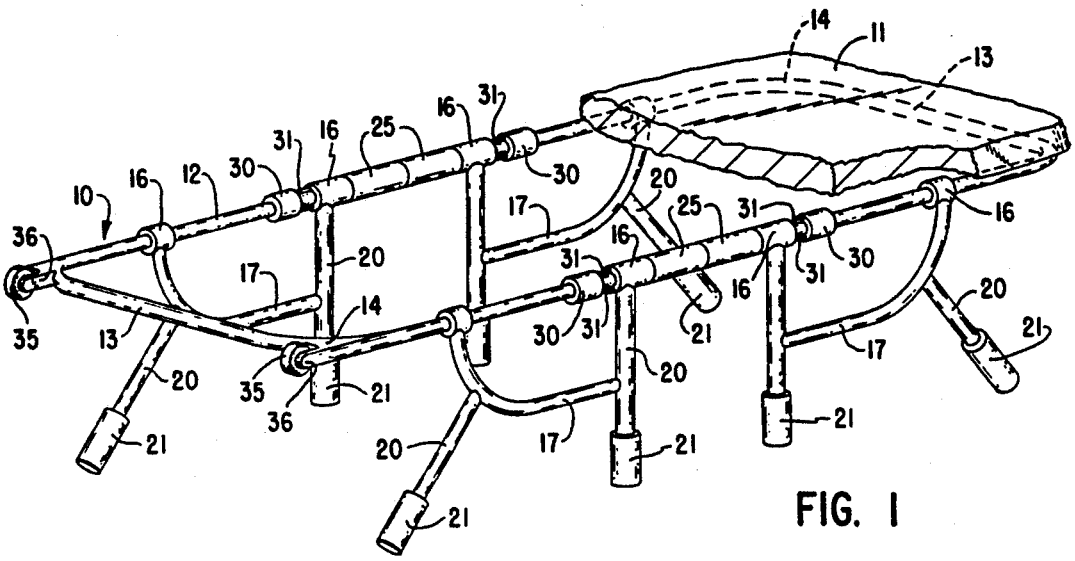
FIG. 1 is a perspective view of the gurney of the invention with both handles in a downward position.

Briefly this invention comprises a stretcher or carried gurney having handles adapted to be adjusted for easy carrying of the device with a patient in positions often encountered and in which ordinary stretchers are inconvenient.

More specifically and referring to the drawings, the device includes a frame 10 which is of the usual shape and which is ordinarily covered by a bed 11 onto which the patient may be strapped in the usual way either relatively loosely or for immobilization. The frame 10 includes side rails 12 and end rails 13 which may be formed from a single piece of tubing or rod. The frame preferably has rounded corners 14. The described structure is not uncommon in the art.

The uniqueness of this device is in the provision of handles for the carrying. These handles include bearing members 16 rotatably journalled on the side rails 12. A curved handle member 17 extends between an adjacent pair of members 16. These handles are shaped for easy grasping by the handlers of the device and are spaced from the side rail approximately eight to twelve inches.

Legs 20 extend from the handles 17. Ferrules 21 of rubber or similar material cover the ends of those legs, making possible placement of the gurney on the floor or other surface as shown in FIG. 1.

Figure 2:
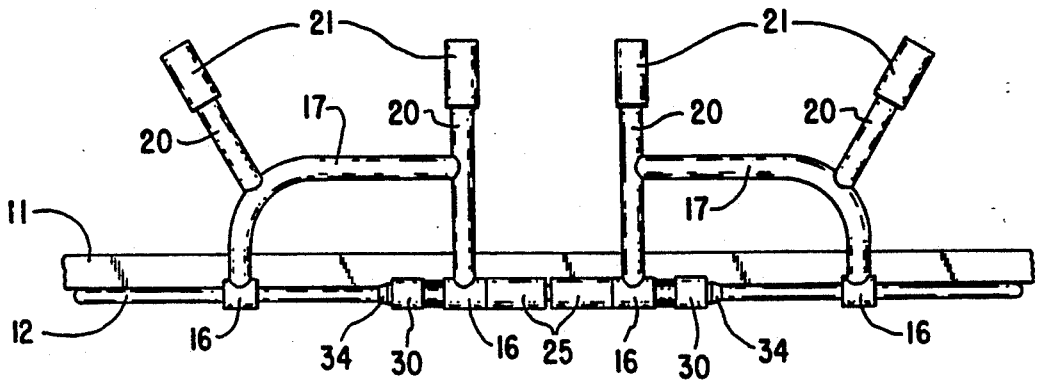
FIG. 2 is an elevational view from the side of the gurney with all handles in the opposite position from that of FIG. 1.

The entire assembly of handles and their bearing members together with the attached legs is rotatable about the side rail 12. Thus, the gurney can be supported as shown in Fig I or, by rotating the handles ninety degrees, the device may be laid flat on the surface so that a patient can be readily placed on the bed 11. Then, if desired, the handles can be rotated to an upper position as shown in FIG. 2 so that the carriers will not have to lift the patient as high as might be required if the handles were in the down position.

Figure 4:
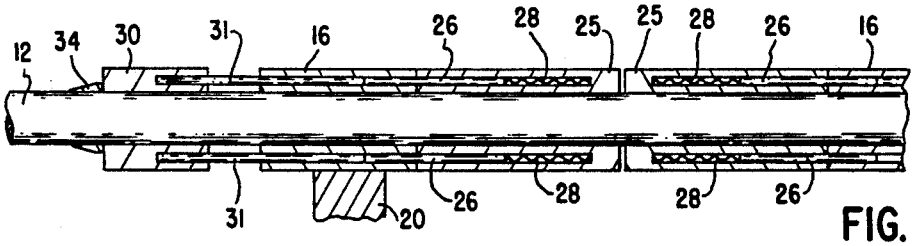
FIG. 4 is a medial sectional view through the locking device for the handles to an enlarged scale and in a locked position.
Figure 5:
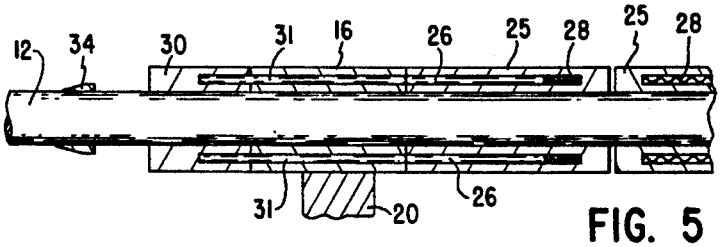
FIG. 5 is a view similar to FIG. 4 showing the device in a released position.

In order to avoid undesired rotation of the handles 17 about the side rails 12, a locking system as shown in FIGS. 4 and 5 should be provided. The preferred system includes a fixed collar 25. Each collar contains a pair of pins 26 slidable axially within recesses in the collar. Compression springs 28 bias the pins 26 to an outward position in which the pin extends well beyond the surface of the collar 25 where it abuts the bearing member 16. These pins then extend into matching recesses in the bearing members 16, thus locking the bearing member in place relative to the collar 25.

To release the locking engagement, a release collar 30 is slidably and rotatably journalled on the side rail adjacent the bearing member 16. This collar is provided with matching pine 31 slidable in the recesses in the bearing member 16. These pins are of such a length that when the release collar 30 abuts the bearing member 16, the end of each pin 31 registers with the division between the bearing member 16 and the stationary collar 25. Thus, the spring loaded pins 26 are pushed against the biassing force of the springs 28 so that the outer end of the pins 26 also coincide with the division. In this position, the bearing member 16 together with the release collar 30 may be rotated on the side rail 12 until the pins 26 may again be moved into the recesses in the bearing member 16. In this way if there are two recesses diametrically opposed the bearing member 16 can be held in two positions approximately 180 degrees apart.

Intermediate positions could be provided by using additional sockets for the pins and added release pins. However, that is not preferred because in other positions added shear stress would be placed on the pins 26 requiring larger, stronger pins. Further, intermediate positions are not deemed necessary. As will later appear, there are good reasons for handles above and below the bed of the gurney. However, the side rails 12 can be grasped if it is desirable to hold the bed at approximately the position of the hands of the carriers so that a level position for the hands is not needed, and other positions between level and the two opposite stations are equally not needed.

The motion of the release collar 30 may be restricted by a limiting fixed ferrule 34. The ferrule holds the release collar so that the release pins 31 are always engaged in proper angular position relative to the bearing member 16 and need only be slid toward that member to achieve release.

For added utility, a pair of wheels on rollers 35 may be journalled on an axle held in brackets 36 at one end of the frame 10.

In normal use, the patient may be placed on the bed 11 when the handles 17 are in place parallel to the bed and the gurney is flat on the surface, whether ground or floor. In this position, the handles are not pinned so that after the gurney is loaded, the handles can be raised to a vertical position (FIG. 2) where they will be locked. In this position the handles also serve as barriers to lateral motion of the patient which may be desirable if the patient is not immobilized.

If the patent is able to assist, it may be desirable to stand the gurney on its legs (FIG. 1) while the patent is placed on the bed. In this position, the patient need not lie on the floor, and may be more comfortable not having to get down so far.

Figure 3:
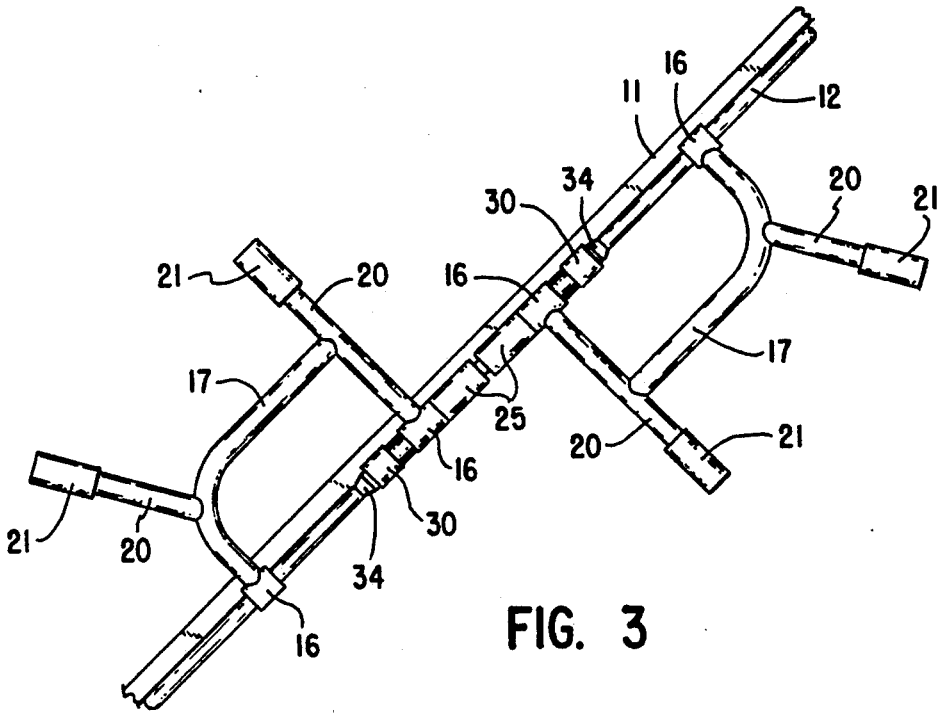
FIG. 3 is an elevational view similar to FIG. 2 with one set of handles in an upward position and one downward.

However, the real problems with carrying patients on a stretcher, and which can be solved with the device of this invention are carrying the patient in buildings having narrow stairs or sharp corners or both. Navigation of such hazards frequently requires that the stretcher be tilted more or less steeply to get around a corner, or that it be held at different levels by carriers at the front and back end when on the stairs. In the present device, such tilting or uneven carrying is easily handled by having one set of handles in an upward position and a second set in a downward position as shown in FIG. 3. This arrangement requires much less strain on the arms of the carriers in order to accomplish the different levels of the head and foot end shown in the figure. Thus, by use of the rotatable handles having two fixed positions, the carrying of patients in certain situations is made considerably easier.

On some occasions, it may be easier for the patient to be rolled over a floor or the like. In such instances, the handles 17 adjacent the rollers 35 may be moved to the upward position, and the entire gurney may then be moved by using the handles at the end opposite the rollers and allowing the rollers to roll on the floor.

I claim:

1. A gurney for carrying a patient, comprising a frame, bed means on said frame adapted to receive a patient, said gurney having a head end and a foot end, a first pair of handle means adjacent to but not extending beyond said head end, a second pair of handle means adjacent to but not extending beyond said foot end, each of said handle means being pivotally attached to said frame and each having a hand hold substantially parallel to but substantially laterally spaced from said frame whereby said hand holds can be grasped adjacent said frame, said handle means also including legs extending from said handle means away from said frame, said handle means each being pivotal on said frame from a first position in which said handle hold is above said frame to a second position in which said hand hold is below said frame, said gurney being adapted to be supported by said legs.

2. The gurney of claim 1 in which releasable locking means is mounted on said frame adjacent each of said handle means whereby said handle means may be independently locked in either of said two positions.

3. The gurney of claim 2 in which each of said handle means includes bearing member pivotally journalled on said frame, stationary collar means fixed on said frame adjacent said bearing member, said collar means being formed with at least two recesses, the axis of each of said recesses being substantially parallel to the axis of rotation of said bearing member, a pin in each of said recesses, each pin being biased in a direction outwardly of said recess, said bearing member also having receiving recesses adapted to register with said recesses in said collar means whereby said pins can be extended into said receive recesses, and release means adapted to push said pins out of said receiving recesses adjacent said biasing so that said bearing member will be free to turn relative to said stationary collar.

4. The gurney of claim 3 in which said release means includes a collar slidably mounted on said frame adjacent said bearing member, said biasing means including release pins adapted to engage said first named pin to push them against the biasing and out of the recesses in said bearing member.

5. The gurney of claim 2 in which said frame includes rollers rotatably mounted at one end thereof whereby said gurney can be titled and then rolled in a tilted position.

* * * * *